US008931121B2

(12) United States Patent
Fabian

(10) Patent No.: US 8,931,121 B2
(45) Date of Patent: Jan. 13, 2015

(54) HYDROTHERAPY TUB

(76) Inventor: Charles Fabian, Brea, CA (US)

( * ) Notice: Subject to any disclaimer, the term of this patent is extended or adjusted under 35 U.S.C. 154(b) by 362 days.

(21) Appl. No.: 13/134,030

(22) Filed: May 26, 2011

(65) Prior Publication Data

US 2012/0144579 A1 Jun. 14, 2012

Related U.S. Application Data

(60) Provisional application No. 61/459,287, filed on Dec. 10, 2010.

(51) Int. Cl.

| | |
|---|---|
| ***A47K 3/00*** | (2006.01) |
| ***A61H 33/02*** | (2006.01) |
| ***A61H 33/00*** | (2006.01) |

(52) U.S. Cl.

CPC ..... *A61H 33/02* (2013.01); *A61H 33/6005* (2013.01); *A61H 33/027* (2013.01); *A61H 33/0087* (2013.01); *A61H 2033/0008* (2013.01); *A61H 33/6021* (2013.01); *A61H 33/6026* (2013.01); *A61H 33/6073* (2013.01)

USPC ..... 4/541.1

(58) Field of Classification Search

USPC ..... 4/541.1–541.6, 559, 661, 584; 601/155–157

See application file for complete search history.

(56) References Cited

U.S. PATENT DOCUMENTS

| | | | | |
|---|---|---|---|---|
| 1,856,318 | A * | 5/1932 | Clarke | 4/541.3 |
| 1,896,938 | A * | 2/1933 | Borowsky | 4/541.4 |
| 3,890,656 | A * | 6/1975 | Mathis | 4/541.4 |
| D244,462 | S * | 5/1977 | Mathis | D23/213 |
| 4,340,982 | A * | 7/1982 | Hart et al. | 4/492 |
| 4,383,341 | A | 5/1983 | Altman | |
| 4,563,781 | A | 1/1986 | James | |
| 4,979,245 | A | 12/1990 | Gandini | |
| 5,012,535 | A | 5/1991 | Klotzbach | |
| 5,809,648 | A * | 9/1998 | Kurth et al. | 29/890.142 |
| 5,836,032 | A * | 11/1998 | Hondo | 15/104.32 |
| 5,862,545 | A | 1/1999 | Mathis et al. | |
| 5,930,851 | A * | 8/1999 | Brunelle | 4/541.1 |
| 5,940,904 | A * | 8/1999 | Lutz | 4/559 |
| 6,199,224 | B1 | 3/2001 | Versland | |
| 6,279,177 | B1 | 8/2001 | Gloodt | |
| 6,357,060 | B2 | 3/2002 | Gloodt | |
| 6,523,192 | B1 | 2/2003 | Gloodt | |
| 7,182,090 | B2 | 2/2007 | Abbott | |
| 7,448,095 | B1 * | 11/2008 | Agaeliaho | 4/538 |
| 7,614,095 | B2 * | 11/2009 | Swart et al. | 4/541.5 |
| 2001/0027573 | A1 | 10/2001 | Gloodt | |
| 2008/0172783 | A1 * | 7/2008 | Smith et al. | 4/541.4 |

* cited by examiner

*Primary Examiner* — Huyen Le

*Assistant Examiner* — Erin Deery

(74) *Attorney, Agent, or Firm* — Dennis L. Thomte; Thomte Patent Law Office LLC

(57) ABSTRACT

A hydrotherapy tub including a water and air piping system which is easily cleanable in a thorough manner. A manifold is mounted on the outer surface of each side wall of the tub with each manifold having a water conduit and an air conduit which are fluidly connected to sources of pressurized water and air respectively. The water conduit and air conduit in each manifold is fluidly connected to horizontally spaced-apart discharge ports formed in the associate side wall of the tub.

2 Claims, 8 Drawing Sheets

HYDROTHERAPY TUB

CROSS-REFERENCE TO RELATED APPLICATION

This application claims the benefit of Provisional Application Ser. No. 61/459,287, filed on Dec. 10, 2010, entitled A HYDROTHERAPY TUB.

BACKGROUND OF THE INVENTION

1. Field of the Invention

This invention relates to a hydrotherapy tub or bathtub and more particularly to a hydrotherapy tub having a water and air piping system which is completely and easily cleanable.

2. Description of the Related Art

Traditional hydrotherapy or jetted tubs or bathtubs have a plurality of piped jets or discharge nozzles mounted in the walls thereof in a horizontally spaced-apart manner. The jets or nozzles protrude outwardly into the interior of the tub and are uncomfortable to lean against. Additionally, the jets or nozzles are not cosmetically pleasing in appearance. Further, the limited number of jets, which may be six to ten, create many dead areas or zones in which there is no hydrotherapy action.

More importantly, the conventional jetted hydrotherapy tubs pose a health problem in that infectious bacteria may be present in the piping system and jets. The only way that the bacteria may be reduced or eliminated in such systems is to place an anti-bacterial solution in the tub and pump the same through the system in an attempt to kill the harmful bacteria therein. Even if an anti-bacterial solution is periodically pumped through the system, bacteria will still accumulate in the system and jets between such treatments. In the prior art hydrotherapy tubs, a certain amount of water will be present inwardly of each of the jets or nozzles even when the system is not being operated with that water being a harbor for infectious bacteria to grow.

SUMMARY OF THE INVENTION

This summary is provided to introduce a selection of concepts in a simplified form that are further described below in the Detailed Description. This summary is not intended to identify key aspects or essential aspects of the claimed subject matter. Moreover, this summary is not intended for use as an aid in determining the scope of the claimed subject matter.

A hydrotherapy tub is provided which has a bottom wall, an upstanding first end wall, with inner and outer sides, an upstanding second end wall with inner and outer sides, an upstanding first side wall with inner and outer sides, an upstanding second side wall with inner and outer sides, and a sill at the upper ends of the end and side walls. A water pump is positioned adjacent the tub and has intake and discharge sides. An air pump is also positioned adjacent the tub and has intake and discharge ends. The system of this invention includes a generally horizontally extending first elongated manifold positioned at the outer side of the first side wall and a generally horizontally extending second elongated manifold positioned at the outer side of the second side wall. Each of the first and second manifolds have inner and outer sides and have a plurality of horizontally spaced-apart first bores, having inner and outer ends, formed therein which extend between the inner and outer sides thereof. Each of the first and second manifolds have a plurality of horizontally spaced-apart second bores, having inner and outer ends, formed therein which extend from the first bores to the outer side of the associated manifold.

The first side wall of the tub has a plurality of generally horizontally spaced-apart discharge openings formed therein which extend between the inner and outer sides thereof. The second side wall of the tub has a plurality of generally horizontally spaced-apart discharge openings formed therein which extend between the inner and outer sides thereof. The inner ends of the first bores of the first manifold fluidly communicate with the discharge openings in the first side wall of the tub. The inner ends of the first bores of the second manifold fluidly communicate with the discharge openings in the second side wall of the tub. First and second elongated water conduits are provided which have a first end and a second end. The first ends of the first and second water conduits are in fluid communication with the discharge side of the water pump. First and second elongated air conduits are also provided each of which have a first end and a second end. The first ends of the first and second air conduits are in communication with the discharge end of the air pump. The first water conduit, intermediate its ends, is operatively connected to the first manifold. The first water conduit has a plurality of generally horizontally spaced-apart discharge openings formed therein which fluidly communicate with the outer ends of the first bores of the first manifold. The second water conduit, intermediate its ends, is operatively connected to the second manifold with the second water conduit having a plurality of generally horizontally spaced-apart discharge openings formed therein which fluidly communicate with the outer ends of the first bores of the second manifold. The first air conduit, intermediate its ends, is operatively connected to the first manifold. The second air conduit, intermediate its ends, is operatively connected to the second manifold. The first air conduit has a plurality of generally horizontally spaced-apart discharge openings formed therein which communicate with the outer ends of the second bores of the first manifold. The second air conduit has a plurality of generally horizontally spaced-apart discharge openings formed therein which communicate with the outer ends of the second bores of the second manifold. The outer ends of the first bores of the first and second manifolds are positioned below the outer ends of the second bores in the first and second manifolds. The bottom wall of the tub has at least one opening formed therein which is in fluid communication with the intake side of the water pump.

The tub has a first selectively closable access opening formed therein which is in communication with the second ends of the first and second water conduits to enable a cleaning device to be extended through the first access opening into either of the second ends of the first and second water conduits. The tub also includes a second selectively closable access opening formed therein which is in communication with the second ends of the first and second air conduits to enable a cleaning device to be extended through the second access opening into either of the second ends of the first and second air conduits. An anti-bacterial solution may be poured into either of the first and second access openings with the water and air pumps then being actuated to pump the anti-bacterial solution throughout the system.

It is therefore a principal object of the invention to provide a hydrotherapy tub which provides wrap-around water movement with total coverage.

A further object of the invention is to provide a hydrotherapy tub which has no dead zones provided therein due to the large number of discharge openings formed in the side walls of the tub.

A further object of the invention is to provide a hydrotherapy tub having improved water circulation.

A further object of the invention is to provide a hydrotherapy tub having an air and water system which is completely and easily cleanable.

A further object of the invention is to provide a hydrotherapy tub including access cleaning ports through which a cleaning brush or the like may be extended to clean the system.

A further object of the invention is to provide a hydrotherapy tub having a pair of cleaning ports through which an anti-bacterial solution may be poured.

A further object of the invention is to provide a hydrotherapy tub which does not have any protruding jets or nozzles extending into the interior of the tub.

A further object of the invention is to provide a hydrotherapy tub which may be operated in three different ways: namely, water only, air only, and water and air.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
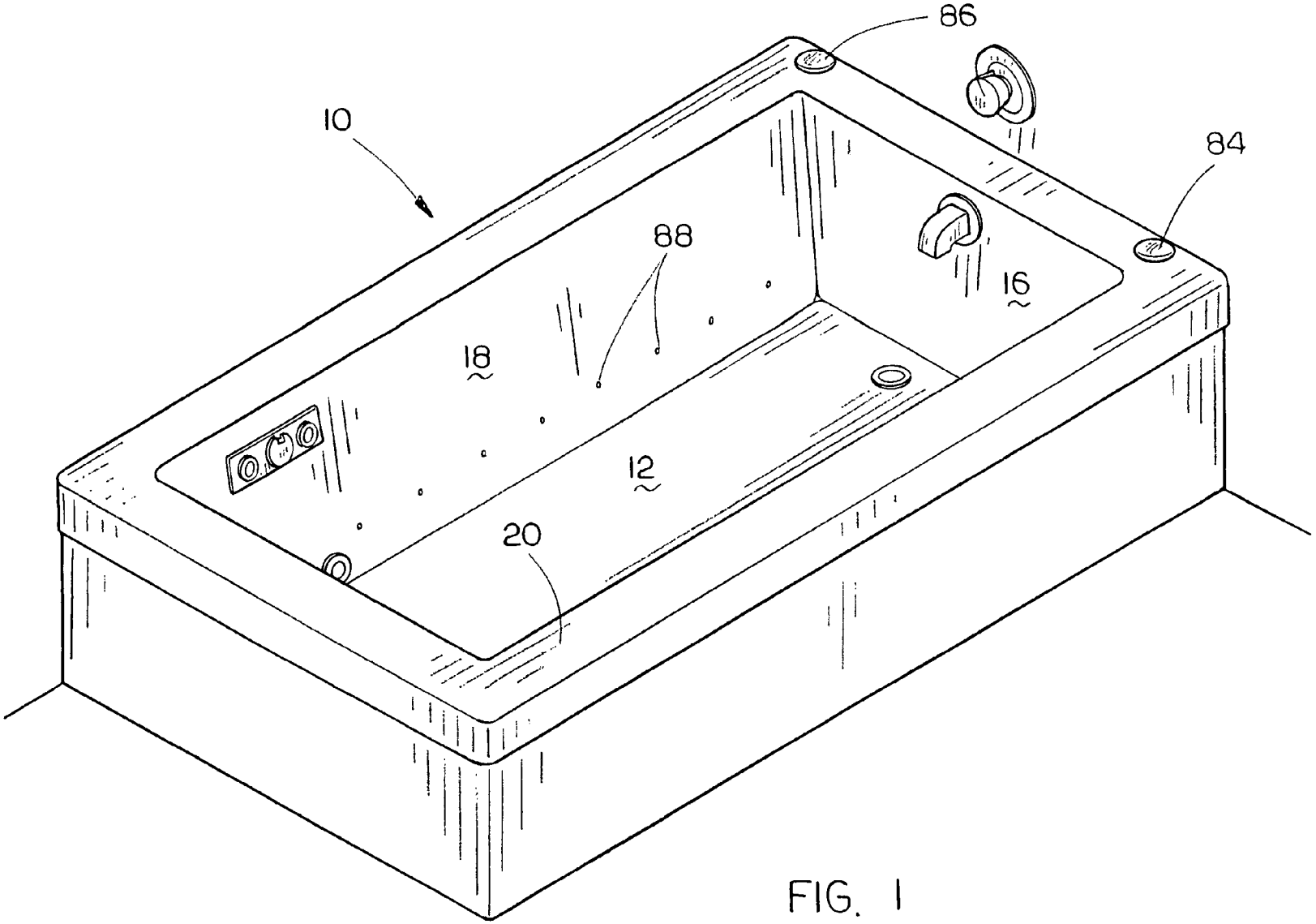
FIG. 1 is a perspective view of the hydrotherapy tub of this invention.
Figure 2:
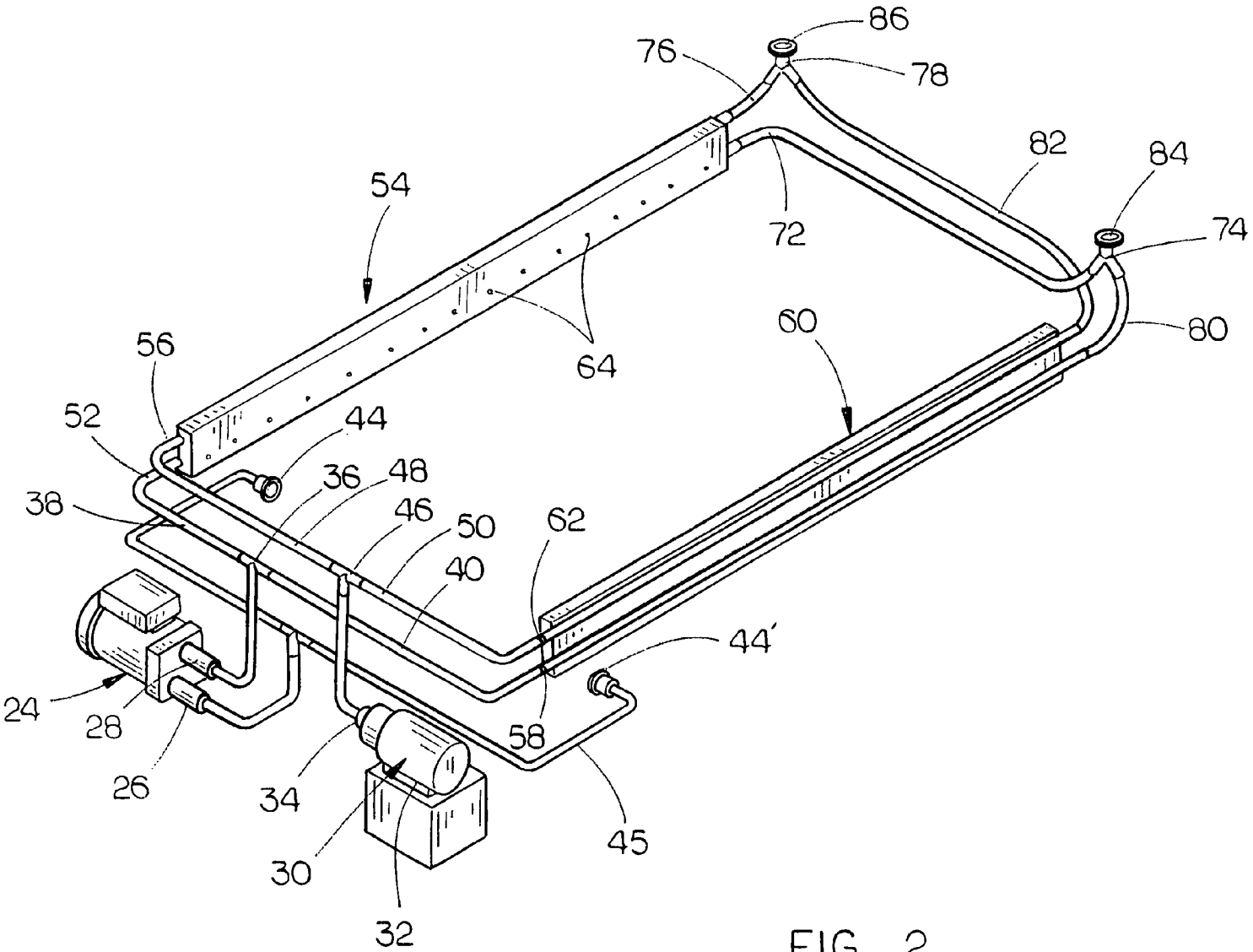
FIG. 2 is a perspective view of the air and water piping system of this invention.
Figure 3:
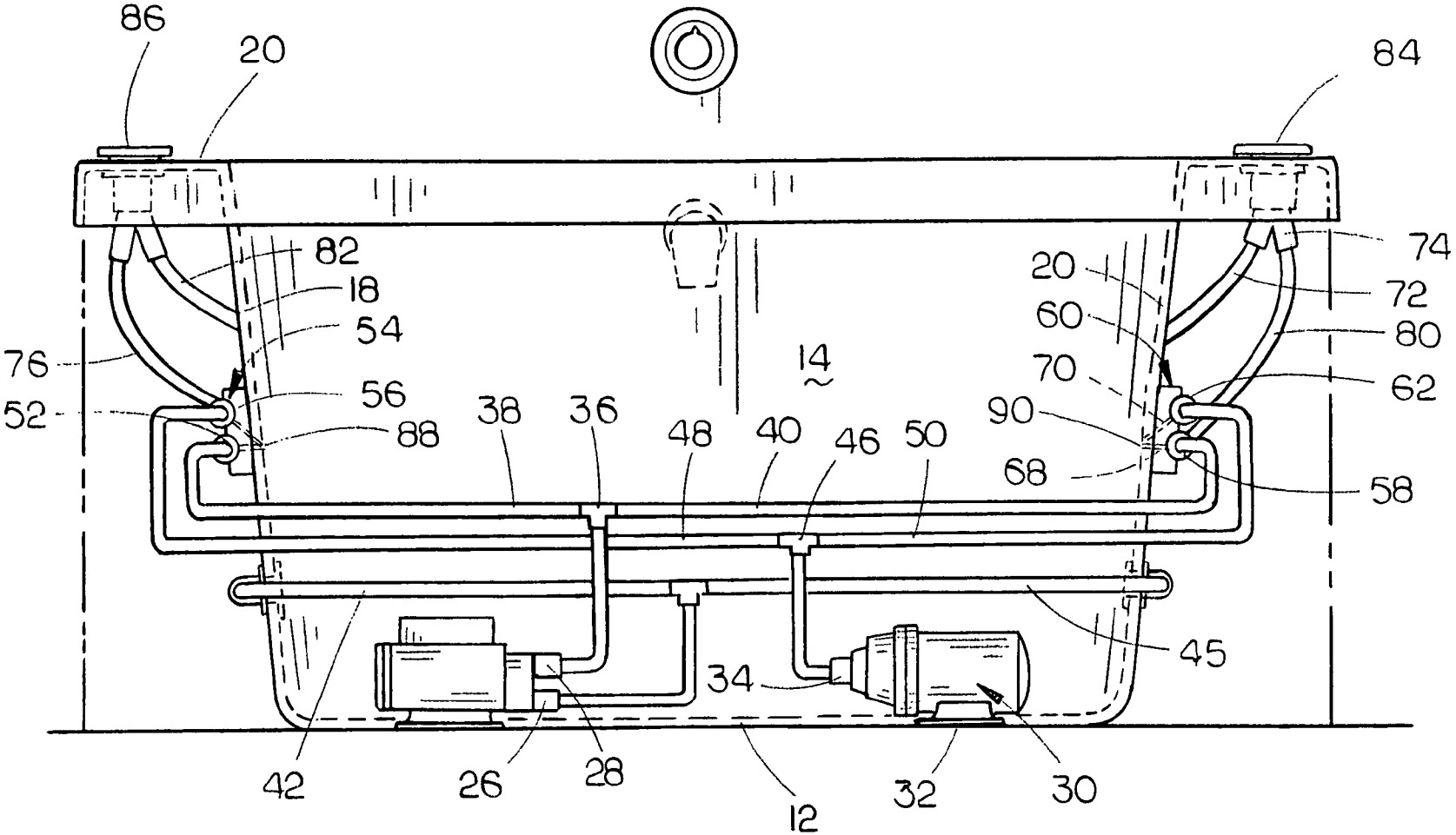
FIG. 3 is an end view of the tub of this invention.
Figure 4:
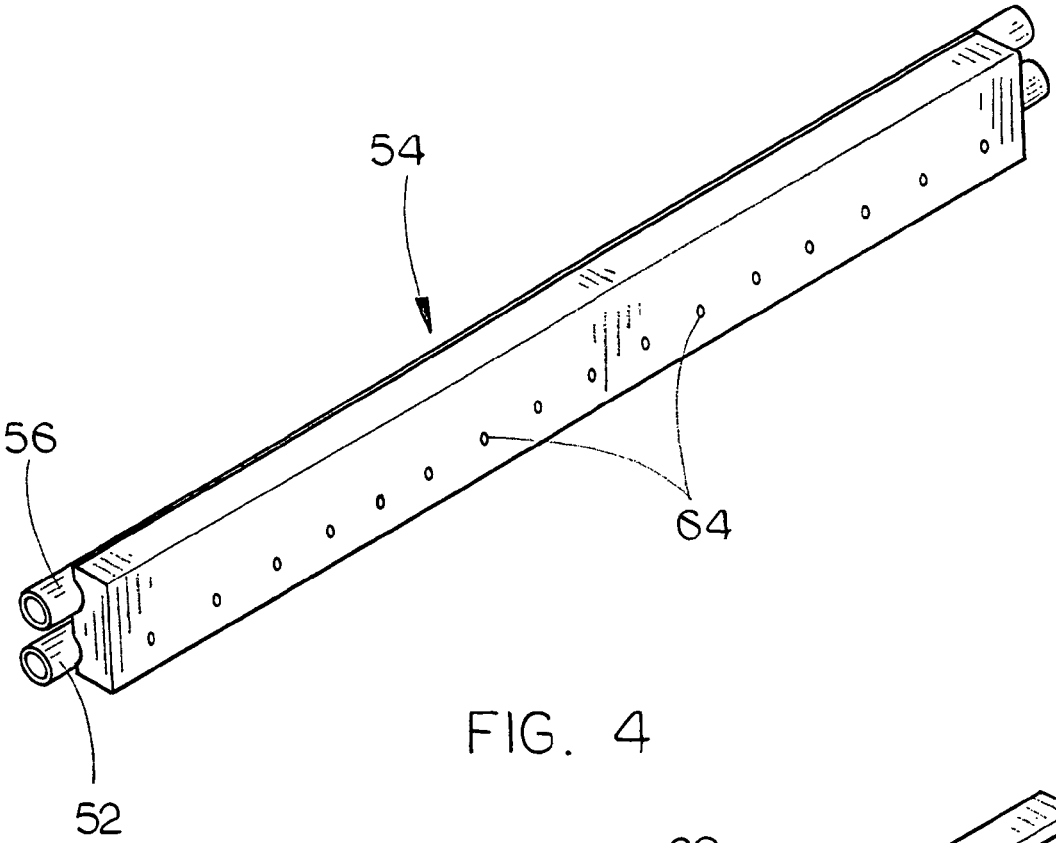
FIG. 4 is a perspective view of the first manifold of this invention.
Figure 5:
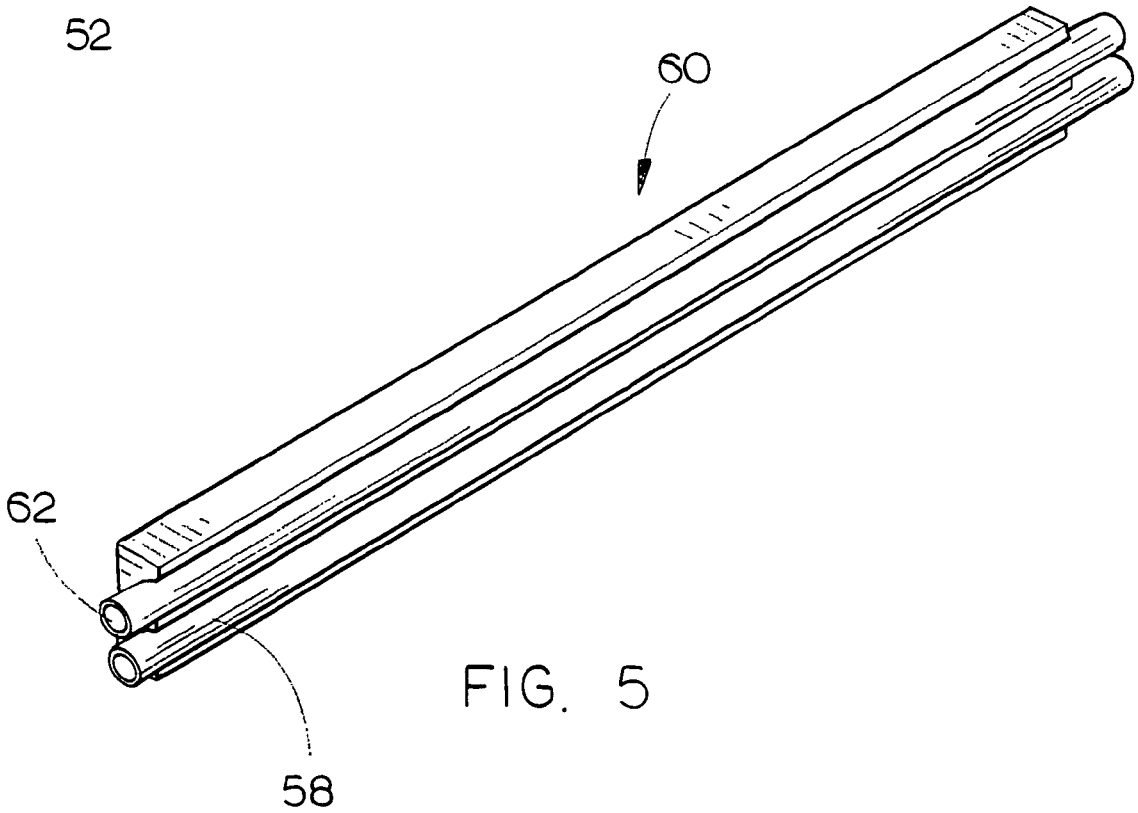
FIG. 5 is a perspective view of the second manifold of this invention.
Figure 6:
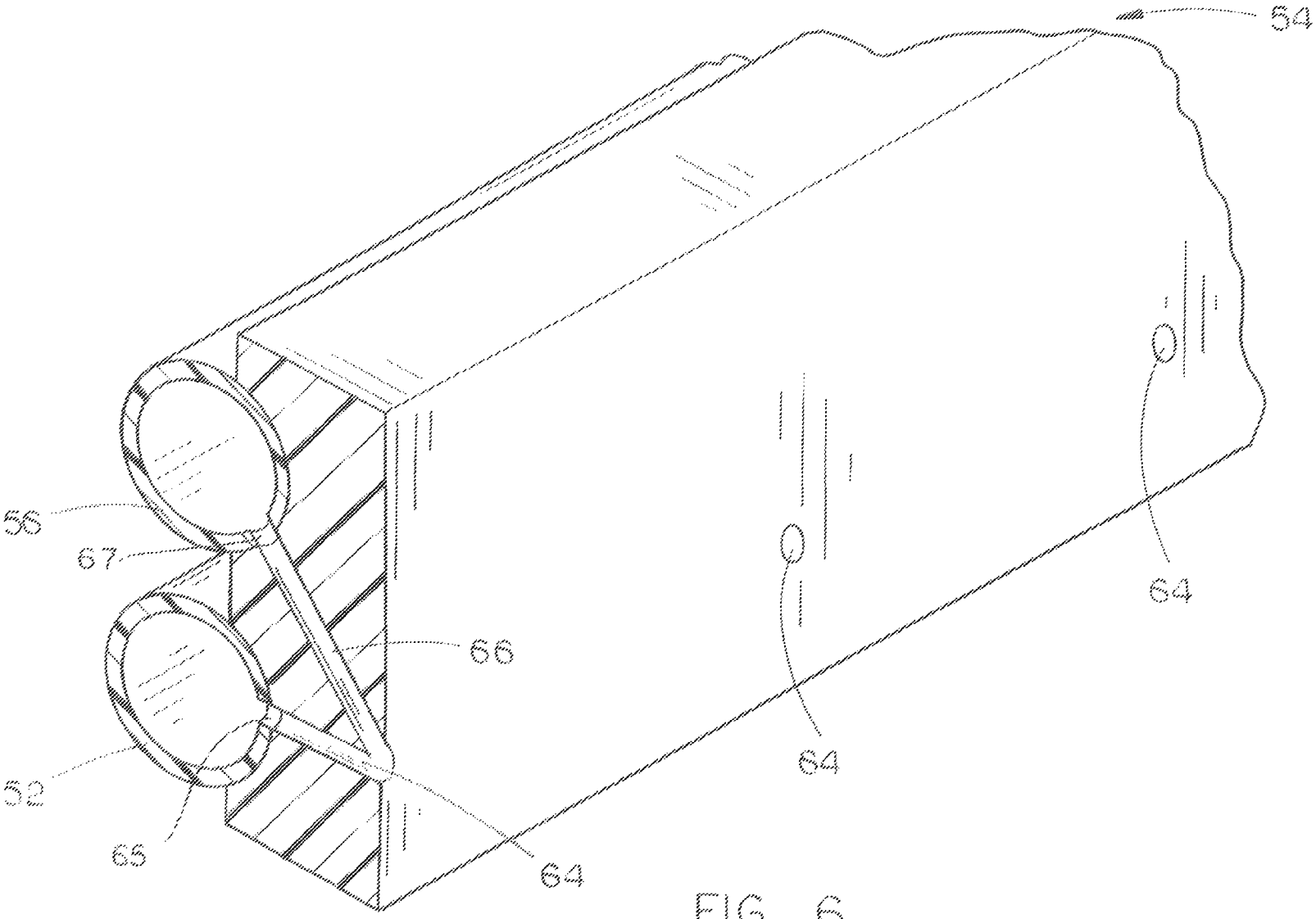
FIG. 6 is a partial perspective view of the first manifold of this invention with portions thereof cut-away to more fully illustrate the invention.
Figure 7:
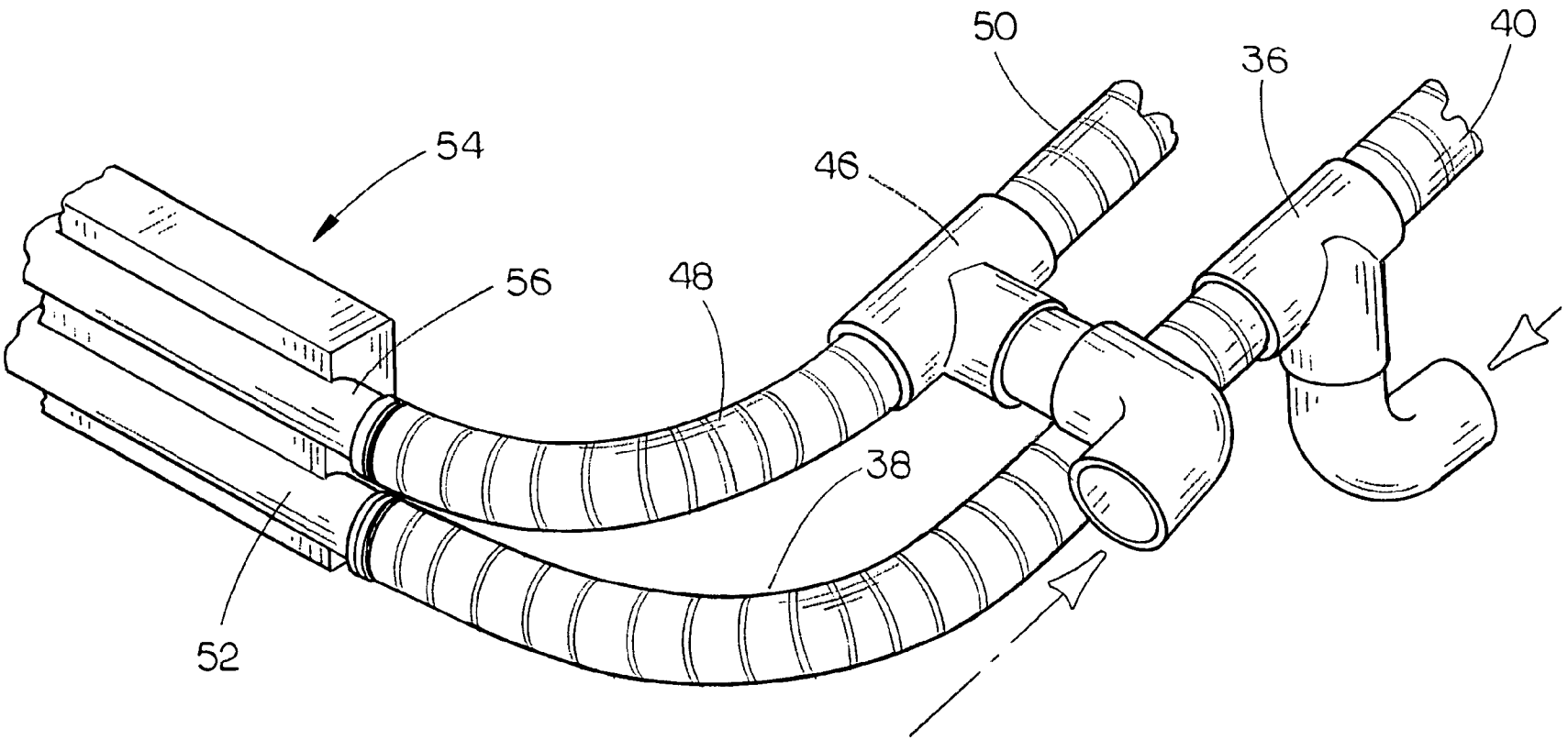
FIG. 7 is a partial perspective view of a portion of the air and water piping system of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The hydrotherapy tub of this invention is referred to generally by the reference numeral 10 which includes a bottom wall 12, an upstanding first end wall 14, an upstanding second end wall 16, an upstanding first side wall 18, an upstanding second side wall 20 and a sill 22 at the upper ends of walls 14, 16, 18 and 20. Each of the walls 14, 16, 18 and 20 has inner and outer sides. It is preferred that the tub be insulated. Tub 10 is provided with a conventional drain opening and a water facet with suitable controls. A conventional motor driven pump 24 is provided at the outer side of end wall 14 and has a water intake side 26 and a water discharge side 28. A conventional motor driven air pump 30 is also provided at the outer side of end wall 14 and has an air intake side 32 and an air discharge side 34. The water discharge side 28 of water pump 24 is in fluid communication with a T-fitting 36 which has flexible hoses or conduits 38 and 40 extending therefrom. The water intake side of water pump 24 is in fluid communication with one end of a water return hose or conduit 42. The other end of hose 42 is in fluid communication with a water return opening or suction opening 44 formed in the lower end of side wall 18 adjacent end wall 14. A second water return opening or suction opening 44' is formed in the lower end of side wall 20 adjacent end wall 14 which is in fluid communication with hose 42 by way of conduit 45.

The air discharge side 34 of air pump 30 is in communication with a T-fitting 46 which has air hoses or conduits 48 and 50 extending therefrom. Water hose 38 extends from T-fitting 36 to one end of a rigid tube or pipe 52 which extends to a first manifold 54 secured to the outer side of side wall 18. Air hose 48 extends from T-fitting 46 to one end of a rigid tube or pipe 56 which extends to the first manifold 54.

Water hose 40 extends from T-fitting 36 to one end of a rigid tube or pipe 58 which extends to a second manifold 60 positioned at the outer side of side wall 20. Air hose 50 extends from T-fitting 46 to one end of a rigid pipe or tube 62 which extends to the second manifold 60. As seen, pipe 56 is positioned above pipe 52 in the manifold 54 and pipe 62 is positioned above pipe 58 in the manifold 60.

Manifold 54 has a plurality of generally horizontally spaced-apart bores 64 formed therein which extend into the inner side of manifold 54. The bores 64 extend to and communicate with the interior of pipe 52 by way of the holes 65 formed in pipe 52. Preferably, the holes 65 are formed in the upper one-third of the pipe 52. Bores 66 are formed in manifold 54 and communicate with the bores 64 and which extend to and communicate with the interior of pipe 56 by way of the holes 67 formed in pipe 56. Preferably, the holes 67 are formed in the pipe 56 approximately ⅛ of an inch above the lower end of pipe 56. Preferably, the bores 64 have a 3/10 inch diameter and are spaced-apart 3 inches. Preferably the bores 66 also have a 3/16 inch diameter. Pipes 52, 56, 60 and 62 preferably have inside diameters of ¾ inch.

Manifold 60 has a plurality of generally horizontally spaced-apart bores 68 formed therein which extend into the inner side of manifold 60. Bores 68 communicate with the interior of pipe 58 by way of holes formed in pipe 58. Bores 70 are also formed in manifold 60 and communicate with the bores 70 and communicate with the interior of pipe 62 by way of holes formed in pipe 62. Preferably, the bores 68 have a 3/16 inch diameter and are spaced-apart 3 inches. Preferably the bores 70 also have a 3/16 diameter. The manifold 60 is reversibly identical to manifold 54.

Water hose 72 extends from pipe 52 to fitting 74. Air hose 76 extends from pipe 56 to fitting 78. Water hose 80 extends from pipe 58 to fitting 74 and air hose 82 extends from pipe 62 to fitting 78. Fitting 74 has an inverted Y-shape at the upper end thereof being in communication with a selectively closable access opening 84 formed in tub 10. Fitting 78 has an inverted Y-shape with the upper end thereof being in communication with a selectively closable access opening 86.

Side wall 18 has a plurality of generally horizontally spaced-apart discharge openings 88 formed therein. Each of the openings 88 communicate with the bores 64 of manifold 54. Side wall 20 also has a plurality of generally horizontally spaced-apart discharge openings 90 formed therein each of which communicate with the bores 68 of manifold 60.

Figure 8:
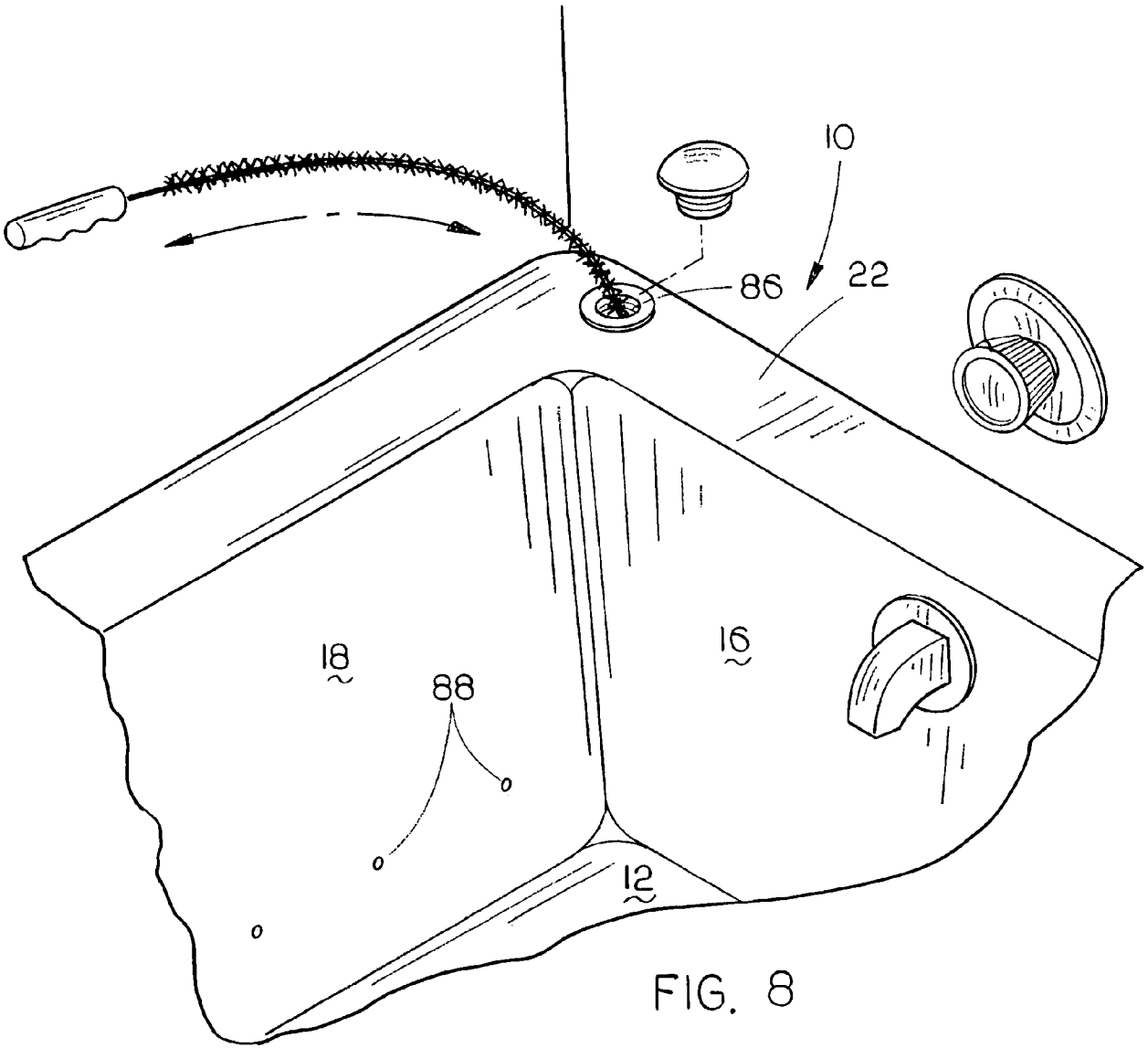
FIG. 8 is a partial perspective view of a portion of the tub of this invention.

It can therefore be seen that a novel hydrotherapy tub has been provided. The design of the manifolds and their relationship with respect to the air and water conduits ensures that there will not be an undue amount of water remaining behind the discharge openings 88 in side wall 18 and the discharge openings 90 in side wall 20. The various air and water conduits may be easily cleaned by way of the selectively closable access openings 84 and 86. As seen in FIG. 8, a cleaning device may be extended downwardly through the access openings so that the air and water conduits may be scrubbed and cleaned. If desired, an anti-bacterial solution may also be introduced into the air and water conduits by pouring the same into the access openings.

It can also be seen that the elimination of the conventional prior art nozzles or jets results in a smooth inner surface of the walls of the tub. A large number of the discharge openings formed in the side walls of the tub ensures that there will not be any dead zones of hydrotherapy action.

Figure 9:
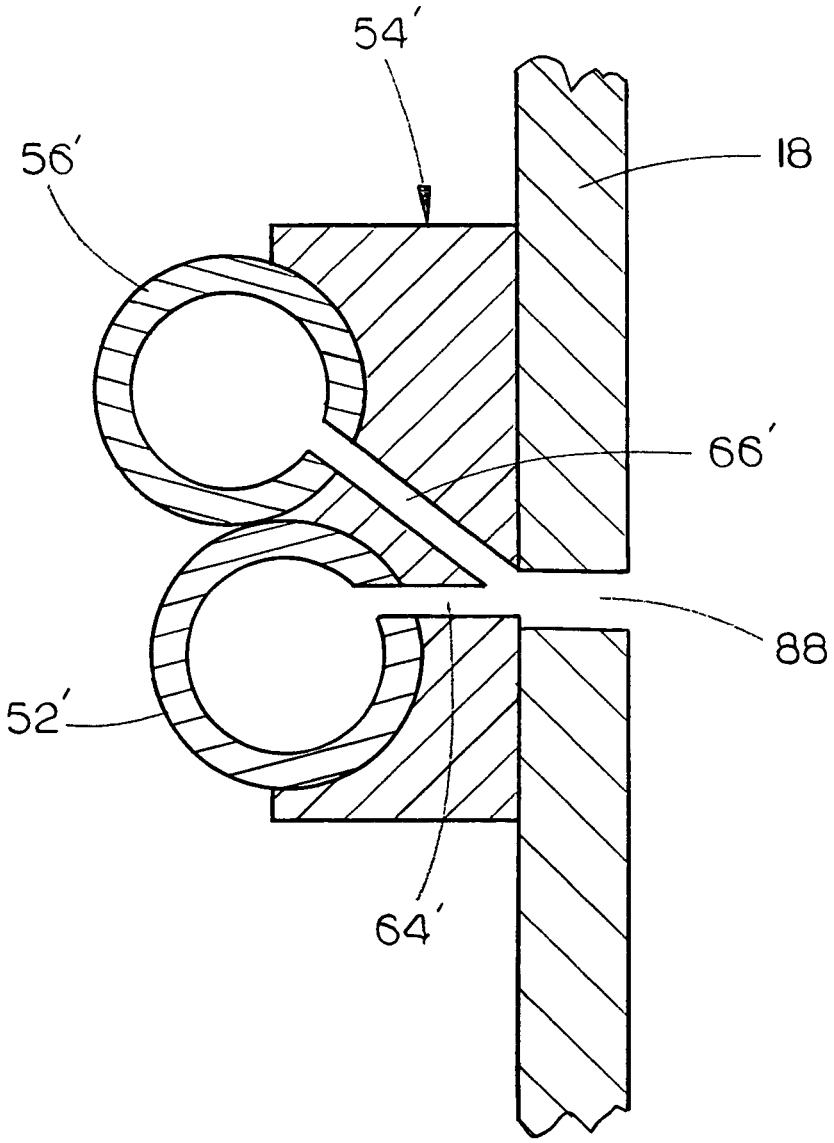
FIG. 9 is a sectional view of a modified form of the first and second manifolds.

FIG. 9 illustrates a modified form of the manifold 54 which is referred to by the reference numeral 54'. The primary difference between manifold 54' and manifold 54 is that air pipe 56' has been lowered so that the pipes 52' and 56' are positioned closely together and that the air pipe 56' is horizontally offset with respect to pipe 52'. Bores 66' extend from pipe 56' and bores 64' extend from pipe 52'. Preferably, the pipes 52' and 56' have inside diameters of ¾ inch. In the embodiment of FIG. 9, the air pipe 56' was lowered and offset with respect to pipe 52' to create a better air flow to the venture chamber and to stop back feed of air into the water which caused pump cavitation. Manifold 60 is similarly modified.

It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

a bathtub having a bottom wall, an upstanding first end wall with inner and outer sides, an upstanding second end wall with inner and outer sides, an upstanding first side wall with inner and outer sides, an upstanding second side wall with inner and outer sides, and a sill at the upper ends of the end and side walls;

a water pump having intake and discharge sides;

an air pump having intake and discharge ends;

a generally horizontally extending first elongated manifold, having a first end, a second end, an upper end, a lower end, an inner side and an outer side, positioned at said outer side of said first side wall of said bathtub;

a generally horizontally extending second elongated manifold, having a first end, a second end, an upper end, a lower end, an inner side and an outer side, positioned at said outer side of said second side wall of said bathtub;

each of said first and second manifolds having a plurality of horizontally spaced-apart first bores, having inner and outer ends, formed therein which extend horizontally thereinto from said inner side thereof;

each of said first and second manifolds having a plurality of horizontally spaced-apart second bores, having inner and outer ends, formed therein which intersect said first bores and which extend upwardly and outwardly from said inner ends of said first bores towards said outer side of the associated manifold;

said inner ends of said first bores of said first and second manifolds intersecting said second bores of said first and second manifolds at said inner ends of said second bores;

said first side wall of said bathtub having a plurality of generally horizontally spaced-apart discharge openings formed therein which extend between said inner and outer sides thereof;

said second side wall of said bathtub having a plurality of generally horizontally spaced-apart discharge openings formed therein which extend between said inner and outer sides thereof;

said inner ends of said first and second bores of said first manifold at the intersection thereof fluidly communicating with said discharge openings in said first side wall of said bathtub;

said inner ends of said first and second bores of said second manifold at the intersection thereof fluidly communicating with said discharge openings in said second side wall of said bathtub;

a first elongated and horizontally disposed tubular water conduit having a first end, a second end, an upper end, a lower end, an inner side and an outer side;

said first water conduit being positioned at said outer side of said first manifold adjacent said lower end of said first manifold;

a second elongated and horizontally disposed tubular water conduit having a first end, a second end, an upper end, a lower end, an inner side and an outer side;

said second water conduit being positioned at said outer side of said second manifold adjacent said lower end of said second manifold;

said first ends of said first and second water conduits being in fluid communication with said discharge side of said water pump;

said first water conduit having a plurality of horizontally spaced-apart water discharge openings formed in said inner side thereof adjacent said upper end thereof which fluidly communicate with said inner ends of said first bores of said first manifold;

said second water conduit having a plurality of horizontally spaced-apart water discharge openings formed in said inner side thereof adjacent said upper end thereof which fluidly communicate with said inner ends of said inner ends of said first bores of said second manifold;

a first elongated and horizontally disposed air conduit, having a first end an a second end, positioned at said outer side of said first manifold above said first water conduit;

said first end of said first air conduit being in communication with said discharge end of said air pump;

said first air conduit having a plurality of spaced-apart air discharge openings formed therein which are in communication with said inner ends of said second bores in said first manifold;

a second elongated and horizontally disposed air conduit, having a first end and a second end, positioned at said outer side of said second manifold above said second water conduit;

said first end of said second air conduit being in communication with said discharge end of said air pump;

said second air conduit having a plurality of spaced-apart air discharge openings formed therein which are in communication with said inner ends of said second bores in said second manifold;

said bathtub having at least one water return opening formed therein which is in fluid communication with said intake end of said water pump;

a first selectively closable access opening formed in said sill at said upper end of said second end wall of said bathtub;

a first inverted generally Y-shaped pipe fitting having a vertically disposed upper pipe with open upper and lower ends; a first pipe member extending downwardly and outwardly from said open lower end of said upper pipe of said first pipe fitting, a second pipe member extending downwardly and outwardly from said open lower end of said upper pipe of said first pipe fitting;

said open upper end of said upper pipe of said first pipe fitting being in fluid communication with said first access opening;

a first hose extending downwardly and outwardly away from said first pipe member of said first pipe fitting to said second end of said first air conduit of said first manifold;

a second hose extending downwardly and outwardly away from said second pipe member of said first pipe fitting to said second end of said second air conduit of said second manifold;

a second selectively closable access opening formed in said sill at said upper end of said second wall of said bathtub;

a second inverted generally Y-shaped pipe fitting having a vertically disposed upper pipe with open upper and lower ends, a first pipe member extending downwardly and outwardly from said open lower end of said upper pipe of said second pipe fitting, a second pipe member extending downwardly and outwardly from said open lower end of said upper pipe of said second pipe fitting;

said open upper end of said upper pipe of said second pipe fitting being in fluid communication with said second access opening;

a third hose extending downwardly and outwardly away from said first pipe member of said second pipe fitting to said second end of said first water conduit of said first manifold;

a fourth hose extending downwardly and outwardly away from said second pipe member of said second pipe fitting to said second end of said second water conduit of said second manifold;

said first access opening being configured whereby a cleaning brush is able to be inserted downwardly thereinto and thence through said upper pipe of said first pipe fitting, thence through said first pipe member of said first pipe fitting, thence through said first hose, and thence through said first air conduit in said first manifold;

said first access opening being configured whereby a cleaning brush is able to be inserted downwardly thereinto and thence through said upper pipe of said first pipe fitting, thence through said second pipe member of said first pipe fitting, thence through said second hose, and thence through said first air conduit in said second manifold;

said second access opening configured whereby a cleaning brush is able to be inserted downwardly thereinto and thence through said upper pipe of said second pipe fitting, thence through said first pipe member of said second pipe fitting, thence through said third hose, and thence through said first water conduit in said first manifold;

said second access opening being configured whereby a cleaning brush is able to be inserted downwardly thereinto and thence through said upper pipe of said second pipe fitting, thence through said second pipe member of said second pipe fitting, thence through said fourth hose, and thence through said second water conduit in said second manifold.

2. The combination of claim 1 wherein said second access opening is configured whereby a liquid disinfectant is able to be introduced therein to disinfect said first and second water conduits in said first and second manifolds respectively.

* * * * *